US005935422A

United States Patent [19]

Zinnen

[11] Patent Number: 5,935,422

[45] Date of Patent: Aug. 10, 1999

[54] REMOVAL OF ORGANIC SULFUR COMPOUNDS FROM FCC GASOLINE USING REGENERABLE ADSORBENTS

[75] Inventor: Herman A. Zinnen, Evanston, Ill.

[73] Assignee: UOP LLC, Des Plaines, Ill.

[21] Appl. No.: 08/998,932

[22] Filed: Dec. 29, 1997

[51] Int. Cl.[6] ..... C10G 25/00; C07C 7/12

[52] U.S. Cl. ..... 208/310 Z; 585/820

[58] Field of Search ..... 585/820; 208/310 Z

[56] References Cited

U.S. PATENT DOCUMENTS

| | | | |
|---|---|---|---|
| 3,051,646 | 8/1962 | Brooke | 208/250 |
| 3,211,644 | 10/1965 | Clark | 208/245 |
| 3,620,969 | 11/1971 | Turnock | 208/245 |
| 3,718,710 | 2/1973 | Quisenberry | 260/683 |
| 4,453,029 | 6/1984 | Dessau | 585/328 |
| 4,593,150 | 6/1986 | Barthnomeuf | 585/828 |
| 4,655,796 | 4/1987 | Pickle, Jr. | 585/820 |
| 4,830,733 | 5/1989 | Nagji | 208/208 R |
| 4,830,734 | 5/1989 | Nagji et al. | 208/208 R |
| 5,041,693 | 8/1991 | Zarchy | 585/826 |
| 5,114,689 | 5/1992 | Negji et al. | 423/230 |

*Primary Examiner*—Helane Myers
*Attorney, Agent, or Firm*—Thomas K. McBride; Frank S. Molinaro

[57] ABSTRACT

Removal of aromatic sulfur compounds from an FCC feedstock with minimal adsorption of aromatic hydrocarbons is achieved using a zeolite Y exchanged with alkali or alkaline earth cations. KY is an especially effective adsorbent. Where the KY is impregnated with a group VIII metal, particular palladium or platinum, the adsorbent is effectively regenerated by treatment with hydrogen at elevated temperatures.

7 Claims, No Drawings

REMOVAL OF ORGANIC SULFUR COMPOUNDS FROM FCC GASOLINE USING REGENERABLE ADSORBENTS

BACKGROUND OF THE INVENTION

Diverse types of petroleum feedstocks contain sulfur compounds whose removal is an indispensable prerequisite for commercial utilization of the feedstock, for subsequent processing of the feedstock, or both. Consequently, it is no surprise that substantial efforts have been expended to eliminate sulfur-containing materials from petroleum products. For example, the Claus process is commercially employed in removing hydrogen sulfide from feedstocks, at least for large streams containing large amounts (greater than about 1000 ppm) hydrogen sulfide. The Stretford process is a vanadium-based oxidative conversion of hydrogen sulfide to sulfur. A non-oxidative method of hydrogen sulfide removal is exemplified by the work of Bricker and Imai, U.S. Pat. No. 5,034,118.

Various oxidative processes also are known for removal of mercaptans by converting them to disulfides; many of these are available as the Merox™ process (see Handbook of Petroleum Refining Processes, R. A. Meyers, editor-in-chief, chapter 9.1, McGraw-Hill Book Company (1986)). It is also known to remove mercaptans and disulfides from petroleum feedstocks by adsorption with clays; see U.S. Pat. No. 5,360,536. In fact, adsorptive processes for sulfur removal may have elements of generality not shared by some oxidative processes.

U.S. Pat. No. 3,051,646 uses molecular sieves to selectively remove sulfur and sulfur-containing compounds such as mercaptans and disulfides. By using molecular sieve adsorbents with an average pore diameter of 8–20 angstroms the patentee avoided significant removal of hydrocarbon components. Hydrogen subsequently was used to desorb the adsorbed sulfur compounds and thus regenerate the molecular sieve. U.S. Pat. No. 3,211,644 teaches the use of crystalline zeolitic molecular sieve materials with an approximate pore size of at least 3.8 Å, including zeolite X, to adsorb sulfur-containing compounds from liquid hydrocarbon feedstocks with subsequent desorbtion of the sulfur compounds from the molecular sieves using a non-adsorbable purge gas, e.g., methane, hydrogen, nitrogen, and carbon dioxide. The patentee of U.S. Pat. No. 3,620,969 teaches that zeolitic molecular sieves dehydrated to a stated residual water loading may be used as an adsorbent for liquid hydrocarbon feeds with thermal swing desorption of the adsorbed sulfur compounds using a conventional purge gas with a high water content. U.S. Pat. No. 5,114,689 recognized the disadvantages and problems associated with the regeneration of molecular sieve adsorbents used in the desulfurization of hydrocarbon streams and suggested solutions thereto.

Although the prior art relating to the use of molecular sieves as adsorbents for removal of sulfur compounds is relatively well developed, there are unique problems in attempting to utilize molecular sieves for the analogous purification of FCC feedstocks. In particular, the different nature of FCC streams insures a substantially different nature in the sulfur-containing organic material. In fact, the sulfur-containing organic material in FCC streams are highly aromatic, in contrast to the sulfur streams of, for example, distillate gasoline, which has two important consequences. One consequence is that the nature of some major sulfur-containing organic materials is quite analogous to the major components of the FCC hydrocarbon matrix, making it more difficult to find molecular sieves which will selectively adsorb the offending sulfur-containing materials. A second consequence is that the adsorbed sulfur-containing material is sufficiently strongly adsorbed that regeneration of the molecular sieve by conventional means is ineffective. Since once-through use of adsorbents simply is impractical and quite uneconomical, regenerability of molecular sieves is a sine qua non for any commercially viable process.

We have devised an effective process to remove sulfur-containing compounds from FCC feedstocks based on certain molecular sieves impregnated with active hydrogenation metals. In particular, where the adsorbent is a potassium-exchanged zeolite Y with palladium or platinum dispersed thereon, we have found it is not only possible to selectively adsorb heterocyclic sulfur-containing compounds so prevalent in the FCC feedstocks without a concomitant significant loss of aromatic hydrocarbons, but it is also possible to effectively regenerate the sulfur-laden adsorbents. Regeneration is performed in a hydrogen atmosphere at elevated temperatures in what is in effect a reductive desulfurization stage.

SUMMARY OF THE INVENTION

The purpose of our invention is to provide a process for removal of organic sulfur compounds from petroleum feedstocks using a regenerable sorbent. Although our invention is quite general in scope, it is particularly applicable to FCC feedstocks where our invention provides a process for selective removal of organic sulfur compounds, especially heterocyclic sulfur compounds, using a regenerable sorbent. An embodiment comprises contacting an FCC feedstock with a zeolite Y exchanged with an alkali or alkaline earth metal cation and impregnated with a group VIII metal. In a more specific embodiment the zeolite Y is exchanged with an alkali metal. In a still more specific embodiment the alkali metal is potassium. In another embodiment the group VIII metal is platinum. In yet another specific embodiment the zeolite Y is potassium exchanged and impregnated with zerovalent platinum.

DESCRIPTION OF THE INVENTION

We have developed a process for removal of organic sulfur compounds, particularly heterocyclic sulfur compounds, from petroleum feedstocks, and especially FCC feedstocks, which overcomes the prior art limitations of poor selectivity and non-regenerability of the sorbent. We have observed that zeolite Y exchanged with an alkali or alkaline earth cation metal selectively adsorbs the organic sulfur compounds from petroleum feedstocks, especially FCC feedstocks, with little attendant adsorption of aromatic hydrocarbons from the feedstock. We also have observed that if the alkali metal or alkaline earth metal cation exchanged zeolite Y also is impregnated with a group VIII metal, then regeneration of the sorbent is achieved by heating the sulfur-laden adsorbent in a hydrogen atmosphere at temperatures in the range of 25 up to about 500° C. These observations afforded our invention, which is a process of selective adsorption of organic sulfur compounds, and especially heterocyclic sulfur-containing compounds, from petroleum feedstocks, particularly FCC feedstocks, with subsequent regeneration of exhausted sorbent.

It needs to be stressed that our invention is applicable to petroleum feedstocks generally. Exemplary of petroleum feedstocks which may be used in the practice of this invention include kerosine, middle distillates, light gas oil, coker naphtha, and so forth. However, the petroleum feedstocks to which our invention is particularly applicable are FCC feedstocks. The FCC feedstocks referred to herein are typically withdrawn as a particular boiling point range from the upper portion of the so-called FCC Main Column. FCC gasoline is characterized as having a boiling point in the range of C5 paraffins up to about 450° F. Such material is composed of many kinds of discrete hydrocarbons, including olefins, paraffins, and aromatics. Such material also has sulfur-containing materials such as benzothiophene and thiophene, which are representative of heterocyclic sulfur compounds, and various types of mercaptans (thiols) with the total concentration amounting to as much as several thousand ppm. The subsequent description shall refer almost exclusively to FCC feedstocks, but it is to be clearly understood that this is done not only to reflect the relative importance of this particular feedstock in the practice of our invention but also to represent illustratively the feedstocks for which our invention may be practiced.

One characteristic of FCC feedstocks is that the nature of the sulfur impurities generally is significantly different from the nature of sulfur-containing materials, in, for example, distillate fuels. In particular, FCC feedstocks contain aromatic heterocyclic sulfur compounds in addition to mercaptans, whose adsorptive properties are quite similar to the aromatic compounds of the hydrocarbon matrix in FCC feedstocks. As previously mentioned, this makes it significantly more difficult to selectively remove sulfur-containing materials from FCC feedstocks than for other feedstocks. Among the aromatic heterocyclic compounds of particular interest in this application are thiophene, 2-methylthiophene, 3-methylthiophene, 2-ethylthiophene, benzothiophene, and dimethylbenzothiophene. Mercaptans which will be removed by the process of this invention often contain from 3–10 carbon atoms, and are illustrated by materials such as 1-mercaptopropane, 2-mercaptopropane, 1-mercaptobutane, 2-mercaptobutane, 2-methyl-2-mercaptopropane, mercaptopentanes, mercaptohexanes, mercaptoheptanes, mercaptooctanes, mercaptononanes, and mercaptodecanes. The total sulfur content in FCC feedstocks usually is in the range from about 150 to as much as several thousand ppm. After treatment according to our invention the sulfur content is desirably no more than about 100 ppm, and most desirably under about 50 ppm. The process which is our invention is particularly suitable for feedstocks with relatively low aromatic content, or for fractions high in benzothiophene or alkylated benzothiophene.

We have found that zeolite Y is suitable for adsorption of sulfur compounds from FCC feedstocks without significant loss of FCC hydrocarbons. In particular, we have found that zeolite Y, which has been exchanged with an alkali or alkaline earth metal cation, shows good adsorption capacity for aromatic heterocyclic sulfur compounds. Among the cations which may be used are included lithium, sodium, potassium, rubidium and cesium, exemplifying the alkali metal cations, and beryllium, magnesium, calcium, strontium, and barium as exemplifying the alkaline earth metal cations. Although any of the alkali and alkaline earth metal cation exchanged zeolite Y materials may be used in the practice of our invention, the alkali metal exchanged materials are preferred, and among these the sodium and potassium exchanged materials are most desirable. In the absence of exchange, oligomerization of olefins present in the FCC feedstock often occurs to the extent of affording significant gum formation and attendant lower octane of the FCC material. The alkali metals in particular reduce the acidity of the zeolite Y affording lower oligomerization with minimal effect on octane. In the practice of our invention we most prefer the potassium exchanged material. Typically, there is at least 50% of the exchangeable sites occupied by an alkali or alkaline earth metal cation, although our preference is to have essentially all of the available sites exchanged with the alkali or alkaline earth metal cation. Adsorption of organic sulfur compounds by the adsorbents of our invention is conveniently effected by contacting the feedstock with exchanged zeolite X at temperatures from about 25 to about 200° C. for a time sufficient to adsorb the organic sulfur compounds present and reduce sulfur content to less than 100 ppm, and preferably less than 50 ppm.

Even though the alkali metal or alkaline earth metal cation exchanged zeolite Y is an effective selective adsorbent for the aromatic heterocyclic sulfur materials present in FCC feedstocks, nonetheless its lack of regenerability precludes successful use in a commercial process. Thus, treatment with hydrogen in accord with prior art regeneration procedures fails to regenerate the sorbent from a sulfur-laden sorbent bed. However, if the sorbent is impregnated with a group VIII metal, we have observed that sorbent can be regenerated upon contact with hydrogen, especially at somewhat elevated temperatures. Among the group VIII metals which may be employed in the practice of our invention are nickel, ruthenium, rhodium, palladium, and platinum, with palladium and platinum apparently the most effective materials. The zeolite Y adsorbents of our invention typically have between 0.05 and about 1.0 wt. % of palladium or platinum (as a zerovalent metal) impregnated thereon. Sulfur-laden zeolite Y having at least one of the group VIII metals impregnated thereon may be readily regenerated by treatment with hydrogen at temperatures from about 25° C. up to about 500° C. but typically at temperatures between about 80 and about 300° C. One notable characteristic of the regenerable KY adsorbents of our invention is their unimpaired capacity and regenerability even after many cycles of operation, a characteristic which is not shared by other regenerable zeolitic adsorbents.

The following examples are illustrative of our invention and are not intended to limit it in any way. Specifically, we emphasize again that our invention is applicable to removal of a broad range of organic sulfur compounds from petroleum feedstocks generally; our description is couched in terms of FCC feed solely for expository convenience. These examples show the preparation of adsorbents, and clearly demonstrate the lack of regenerability of the zeolite Y adsorbents in the absence of a group VIII hydrogenation metal.

EXAMPLE 1

Preparation of Adsorbents

Zeolite Y was a commercial material available from UOP. The commercial material was ammonium ion exchanged at 1 atmosphere, then calcined in steam at 600° C. to afford a dealuminated zeolite Y identified as sample A. A second ammonium ion exchange followed by further calcination afforded a second dealuminated zeolite Y identified as sample B. The properties of the zeolite Y materials are given in Table 1.

TABLE 1

Typical Properties of Y Zeolites

| Adsorent | Surface area, $m^2$/gm | Unit Cell Size Angstroms | $SiO_2/Al_2O_3$ |
|---|---|---|---|
| Y | 870 | 24.68 | 4.8 (a) |
| Sample A | 720 | 24.52 | 8.1 (a) |
| Sample B | 770 | 24.55 | 8.86 (b) |

(a) estimated from unit cell size
(b) measured

TABLE 2

Composition of Model FCC Solutions

| Component | Simulated FCC Feed |
|---|---|
| 1-hexene | 26.92 |
| 2-methylhexane | 1.63 |
| n-heptane | 35.78 |
| 2-methyl-2-thio-propane | 0.08 |
| methyl cyclohexane | 9.88 |
| benzene | 0.73 |
| 3-methylthiophene | 0.14 |
| o-xylene | 24.48 |
| benzothiophene | 0.15 |
| other hydrocarbons | 0.21 |
| TOTAL | 100 |

An FCC model feedstock, whose composition is given in Table 2, was used in all experiments. The adsorbent cyclic capacity and selectivity for adsorbents was determined by column breakthrough and desorption. A column was equipped with low dead volume fittings and loaded with a measured weight of dried adsorbent material. The column was heated to 65° C., and normal heptane was pumped through the column at a measured liquid hourly space velocity (LHSV). At time zero, the heptane flow was stopped and model solution flow was commenced at the same space velocity. The effluent of the column was collected into fractions and analyzed by gas chromatography. By measuring the breakthrough volumes of the various components, the adsorbent capacities can be obtained.

A column of Y type zeolite, bound with clay and formed into beads, was exchanged with potassium and used in the breakthrough experiment as described above. From the breakthrough profiles of some of the sulfur-containing components in the model FCC feedstock, the capacity of the zeolite for each component could be estimated. In a similar way, capacities were estimated for a K-exchanged, partially dealuminated Y, both agglomerated without a binder and bound with alumina, and a clay bound, lithium exchanged Y. Results are summarized in Table 3.

TABLE 3

Adsorbent Sulfur Compound Capacities

| Adsorbent | LHSV | T, C | 2M2TP wt %[a] | 3-MT[a], wt % | BT[a], wt % |
|---|---|---|---|---|---|
| KY | 7.2 | 65 | 0.25 | 0.16 | 0.65 |
| Sample A | 4.3 | 65 | 0.13 | 0.14 | 0.65 |
| Sample B | 5.5 | 65 | 0.06 | 0.06 | 0.31 |
| LiY | 5 | 65 | 0.16 | 0.06 | 0.08 |

[a]2M2TP: 2-methyl-2-thiopropane 3MT: 3-methylthiophene BT: benzothiophene

A column of zeolite Y, saturated with sulfur compounds in the manner of the prior paragraph, was desorbed by heating the bed in accordance with the teachings of U.S. Pat. No. 4,404,118. The regeneration was conducted according to these prior art teachings by first contacting the adsorbent with hydrogen at 21° C. for 20 minutes. Then, the temperature was raised and the column was contacted with hydrogen at 61–63° C. for 15 minutes. Next the temperature was raised, and the column held at 300–303° C. for 13 minutes. During all these steps, the pressure was 20–21 psig hydrogen and the hydrogen flow rate was in the range of 630–680 GHSV. After the desorption step was completed, another breakthrough was conducted as before to determine the adsorption behavior of the sulfur components. The bed exhibited a dramatic decrease in capacity for the sulfur-containing components. This shows that the regeneration step was ineffective.

Preparation of Regenerable, Potassium-Exchanged Zeolite Y 600 parts sodium Y zeolite, bound with clay and formed into beads was exchanged with 870 parts KCl dissolved in 1600 parts deionized water. The exchange was conducted in a column at 90C at a LHSV=2.4. The composition of the hydrated NaY zeolite and the corresponding hydrated KY zeolite, resulting from exchange, are given in Table 4.

TABLE 4

| Compound | KY, wt. % | NaY, wt. % |
|---|---|---|
| $Al_2O_3$ | 15.6 | 16.2 |
| $Na_2O$ | 0.265 | 9.77 |
| $SiO_2$ | 48.5 | 50.5 |
| $K_2O$ | 15.6 | 0.352 |

One part of the foregoing KY zeolite was placed in a vessel with 27 parts distilled water, 0.015 parts KCl, and 0.01 part $Pt(NH_3)_4Cl_2$. The mixture was heated to between 60–80° C. with stirring for 165 minutes. The supernatant was removed and the adsorbent washed with 13 parts distilled water. The wash water was removed and the adsorbent dried at 90° C. for 16 hours. The adsorbent was then treated with air at 250° C. for 130 minutes at a GHSV of 15–23. Then, the adsorbent was treated with hydrogen at 250° C. for 120 minutes at a GHSV of 112.

A column of this Pt-K-Y type zeolite was used in a breakthrough experiment as described employing the simulated feed solution of Table 1. The same column of Pt-K-Y, saturated with sulfur compounds, was desorbed by heating the bed in accordance with the teachings of U.S. Pat. No. 4,404,118 (2). The regeneration then was conducted according to these prior art teachings with a continual hydrogen flow by first contacting the adsorbent with hydrogen at 25–71° C. for 19 minutes. Then, the temperature was gradually raised and the column was contacted with hydrogen at 288–300° C. for 113 minutes. During all these steps, the pressure was in the range of 20–21 psig hydrogen and the flow rate of hydrogen was in the range of 623–755 GHSV.

The experiments of the prior paragraph were repeated in sequence, whereby the capacity of the regenerated adsorbent was measured via column breakthrough, and the saturated adsorbent resulting therefrom was regenerated. From the breakthrough profiles of some of the components of the simulated FCC hydrocarbon stream, capacities can be estimated at the completion of each breakthrough, and thus are summarized in Table 5.

TABLE 5

| Adsorbent Sulfur Compound Capacities | | | | | | |
|---|---|---|---|---|---|---|
| Adsorbent | LHSV | T, ° C. | 2M2TP[a] wt. % | 3-MT[a], wt. % | BT[a,wt.%] | Notes |
| Pt-K-Y | 6.9 | 65 | 0.26 | 0.40 | 0.72 | first breakthrough |
| Pt-K-Y | 6.2 | 65 | 0.21 | 0.23 | 0.61 | second breakthrough |
| Pt-K-Y | 6.2 | 65 | 0.22 | 0.21 | 0.66 | third breakthrough |
| Pt-K-Y | 6.2 | 65 | 0.26 | 0.21 | 0.70 | fourth breakthrough |

[a]2M2TP: 2-methyl-2-thiopropane. 3-MT: 3-methylthiophene. BT: benzothiophene.

The results of Table 5 show clearly and dramatically that the zeolite Y adsorbent used is regenerable, with virtually unimpaired capacity for adsorption of both of benzothiophene and 2-methyl-2-thiopropane.

What is claimed is:

1. A process for removing organic sulfur compounds from a FCC feedstock stream comprising:

a) contacting said petroleum feedstock stream with an adsorbent of potassium-exchanged zeolite Y impregnated with from about 0.05 to about 1.0 wt. % zerovalent platinum or palladium at a temperature from about 25 to about 200° C. for a time sufficient to adsorb said organic sulfur compounds on said adsorbent to afford a sulfur-depleted petroleum feedstock and a sulfur-laden adsorbent, and b) regenerating said adsorbent by heating the sulfur-laden adsorbent in flowing hydrogen at a temperature from about 25 to about 500° C. for a time sufficient to desulfurize said sulfur-laden adsorbent.

2. The process of claim 1 where the organic sulfur compounds are selected from the group consisting of mercaptans and heterocyclic sulfur compounds.

3. The process of claim 2 where the mercaptans are aliphatic mercaptans having from 3 up through about 10 carbon atoms.

4. The process of claim 2 where the heterocyclic organic compounds are thiophenes and benzothiophenes.

5. The process of claim 1 where the sulfur-depleted petroleum feedstock contains less than 100 ppm sulfur arising from organic sulfur compounds.

6. The process of claim 5 where the sulfur-depleted petroleum feedstock contains less than 50 ppm sulfur arising from organic sulfur compounds.

7. The process of claim 1 where the petroleum feedstock is selected from the group consisting of kerosine, middle distillates, light gas oil, and coker naphtha.

* * * * *

UNITED STATES PATENT AND TRADEMARK OFFICE

CERTIFICATE OF CORRECTION

PATENT NO. : 5,935,422

DATED : August 10, 1999

INVENTOR(S) : Herman A. Zinnen

It is certified that error appears in the above-identified patent and that said Letters Patent is hereby corrected as shown below:

In Claim 1, column 7, line 20, delete "petroleum"and insert --FCC-- before feedstock.

Signed and Sealed this
First Day of February, 2000

*Attest:*

Q. TODD DICKINSON

*Attesting Officer*

*Acting Commissioner of Patents and Trademarks*